US005631525A

United States Patent [19]

Toyota

[11] Patent Number: 5,631,525

[45] Date of Patent: May 20, 1997

[54] ELECTRON STORAGE RING APPARATUS COMPRISING A BENDING MAGNET UNIT

[75] Inventor: Eijiro Toyota, Tokyo, Japan

[73] Assignee: Sumitomo Heavy Industries, Ltd., Tokyo, Japan

[21] Appl. No.: 406,588

[22] Filed: Mar. 20, 1995

[30] Foreign Application Priority Data

Apr. 14, 1994 [JP] Japan ..... 6-075596

[51] Int. Cl.[6] ..... H05H 15/00; H05H 7/00; H05H 11/00

[52] U.S. Cl. ..... 315/503; 315/500; 315/501; 315/504; 313/62

[58] Field of Search ..... 315/502, 500, 315/501, 503, 504; 313/62; 335/210, 213, 297; 336/228

[56] References Cited

FOREIGN PATENT DOCUMENTS 3928037 3/1990 Germany .
4000666 7/1990 Germany .

OTHER PUBLICATIONS

European Search Report Date of completion of Search: 11 Jul. 1995.

C. M. Spencer, "*Fabrication of a Prototype Dipole for the SSC Low Energy Booster*", *IEEE Transactions on Magnetics*, vol. 30, No. 4, pp. 1970–1973 (Jul. 1994).

*Primary Examiner*—Sandra L. O'Shea
*Assistant Examiner*—John Ning
*Attorney, Agent, or Firm*—Burns, Doane, Swecker & Mathis, LLP

[57] ABSTRACT

In an electron storage ring apparatus comprising at least two bending magnet units for defining an electron beam orbit of an arc shape, each of the bending magnet units comprises D-shaped upper and lower coil members each of which has an arc-shaped portion. Upper and lower yokes have grooves for entirely receiving the D-shaped upper and the D-shaped lower coil members, respectively.

11 Claims, 3 Drawing Sheets

ELECTRON STORAGE RING APPARATUS COMPRISING A BENDING MAGNET UNIT

BACKGROUND OF THE INVENTION

This invention relates to an electron storage ring apparatus and, in particular, to an improvement of a bending magnet unit provided to the electron storage ring apparatus. The electron storage ring apparatus of the type is suitable for an apparatus for generating synchrotron radiation light. The synchrotron radiation light will be called SR light hereinunder.

Generally, the electron storage ring apparatus of the type comprises a vacuum chamber for defining an electron beam path of a race track type. Specifically, the vacuum chamber has two linear portions parallel to each other and two arc-shaped portions connecting the two linear portions at the both sides thereof. Each of the arc-shaped portions at the both sides Is provided with a bending magnet unit. The bending magnet unit comprises an iron yoke (hereinunder abbreviated to yoke) and a coil and deflects the electron beam along an orbit of an arc shape. In the vicinity of the electron storage ring apparatus, an injection accelerator for generating and accelerating electrons is arranged. The linear portions comprise an inflector electromagnet for introducing the electrons from the injection accelerator into the vacuum chamber and a plurality of focussing electromagnets.

By the electron storage ring apparatus, the electrons introduced into the vacuum chamber are circulated along an orbit of a race track type, and stored therein. While the electron beam is circulated, the SR light is generated in a tangential direction with the movement of the electron beam in the arc-shaped portion, namely, in the bending magnet unit. The SR light is extracted at a plurality of portions in the arc-shaped portion. Accordingly, the bending magnet unit is provided with a plurality of extraction paths for extracting the SR light.

The electron storage ring apparatus of the type is required to increase as much as possible the strength of a magnetic field generated by the bending magnet unit. For this purpose, it is necessary to widen the sectional area of the yoke. On the other hand, the light strength per unit area is inversely proportional to the square of the length from a light source. Accordingly, it is preferable that each of the plurality of the extraction paths is as short as possible. However, this means that the extraction path for extracting the SR light becomes longer.

Incidentally, the electron beam circulating along the orbit deviates from the orbit for reasons of collision with corpuscles within the vacuum chamber and becomes extinct gradually for reasons of collision with a wall of the vacuum chamber. On collision with the wall of the vacuum chamber, the electrons generate radiation such as $\gamma$ rays and neutron rays. Since the probability of electron being lost within the bending magnet unit is high, radiation is mostly generated within the bending magnet unit. Fortunately, the bending magnet unit has an outer peripheral yoke which is thick, so that it is possible to shield the radiation to some extent. However, the bending magnet unit is not provided with a yoke at an inlet side and an outlet side of the electron beam. Especially, in a conventional bending magnet unit, there is no shielding member for shielding the radiation from the outlet side of the electron beam, so that it is necessary to provide the shielding member for shielding the radiation outside the electron storage ring apparatus.

SUMMARY OF THE INVENTION

It is therefore an object of this invention to provide an electron storage ring apparatus comprising a bending magnet unit capable of restraining increment of a length of an SR light extraction path even though the strength of a magnetic field is increased and capable of having effective radiation shielding function.

Other objects of this invention will become clear as the description proceeds.

On describing the gist of this invention, it is possible to understand that an electron storage ring apparatus comprises at least two bending magnet units for defining an electron beam orbit of an arc shape.

According to this invention, each of the bending magnet units comprises D-shaped upper and lower coil members each of which has an arc-shaped portion and a linear portion and coil receiving grooves for entirely receiving each outer periphery of the coil members, respectively. Each of the bending magnet units includes upper and lower yokes to which the upper and the lower coil members received in the coil receiving grooves are welded so as to face to each other.

DESCRIPTION OF THE PREFERRED EMBODIMENT

Figure 1:
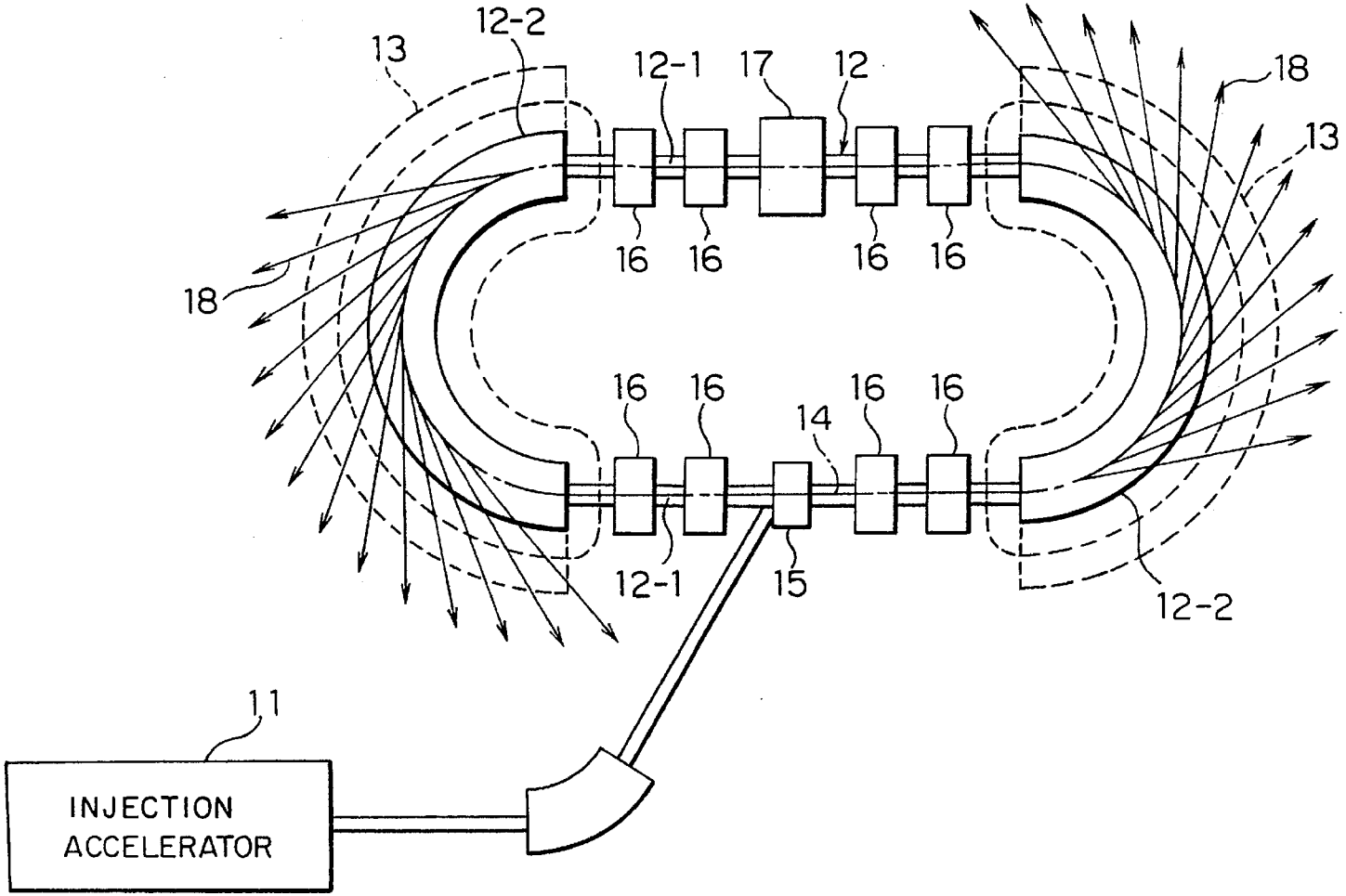
PRIOR ART FIG. 1
FIG. 1 is a plan view showing a substantial structure of an electron storage ring apparatus of a race track type to which this invention is applicable.

With reference to FIG. 1, for a better understanding of this invention, description will be made as regards an electron storage ring apparatus to which this invention is applicable. The electron storage ring apparatus is called a race track type and is used as an SR light generating apparatus. The electron storage ring apparatus circulates, along an orbit of a race track type, electrons or positrons accelerated by an injection accelerator 11.

In this embodiment, description will be made as regards a case of the electron. The electron storage ring apparatus comprises a vacuum chamber 12 of a race track type. The vacuum chamber 12 has two linear portions 12-1 parallel to each other and two arc-shaped portions 12-2 arranged at the both sides thereof. Each of the arc-shaped portions 12-2 of the vacuum chamber 12 is provided with a bending magnet unit 13 shown by a dotted line. The bending magnet unit 13 deflects an electron beam 14 along an orbit of an arc shape within the arc-shaped portion 12-2. The two linear portions 12-1 define two linear orbits for coupling the two arc-shaped orbits. The linear portions 12-1 are provided, at the circumference thereof, with an introducing electromagnet 15 for introducing the electrons from the injection accelerator 11 into the vacuum chamber 12 and converging electromagnets 16, eight in number, each of which comprises a four-pole electromagnet. A high-frequency acceleration cavity 17 is arranged at a linear orbit different from the other linear orbit at which the introducing electromagnet 15 is arranged and has a function of accelerating the electron beam 14.

As mentioned above, the electron storage ring apparatus circulates, within the vacuum chamber 12, the electron beam 14 along the orbit of the race track type including the orbit of the arc shape and stores the electrons therein. While the electron beam 14 is circulated, SR light 18 is generated in a tangential direction with the movement of the electron beam 14 in the bending magnet unit 13. Although the bending magnet unit 13 is provided with a plurality of extraction paths for extracting the SR light 18, an illustration and a description thereof are omitted here.

Figure 2:
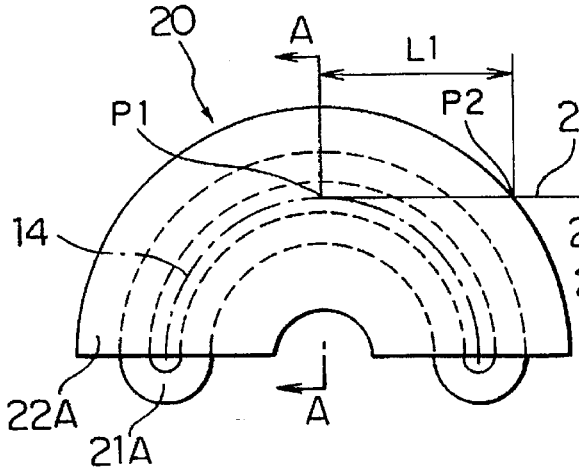
PRIOR ART FIG. 2
FIG. 2 is a plan view showing a first example of a conventional bending magnet unit.
Figure 3:
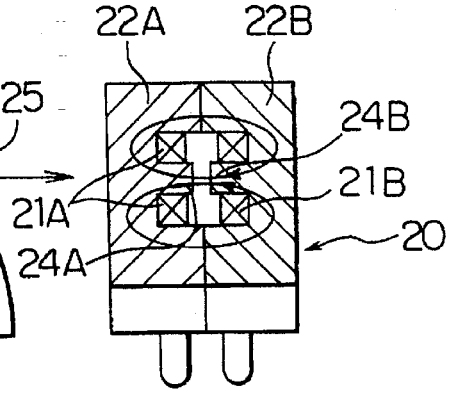
PRIOR ART FIG. 3
FIG. 3 is a vertical sectional view taken along an A—A line in FIG. 2.

With reference to FIGS. 2 and 3, description will be made as regards a first example of a conventional bending magnet unit. A bending magnet unit 20 is suitable for a case that the strength of a magnetic field is not so high. The bending magnet unit 20 comprises C-shaped upper and lower coils 21A and 21B each of which has a curved portion and upper and lower yokes 22A and 22B which have double grooves for receiving the upper coil 21A and the lower coil 21B. Each of the upper and the lower coils 21A and 21B is provided with a current-carrying terminal (not shown). Along a center line of the double grooves of the upper yoke 22A and the lower yoke 22B, an upper pole 24A and a lower pole 24B are formed, respectively, along the orbit of the arc shape of the electron beam 14 indicated in a dash-and-dot line in FIG. 2. When the upper yoke 22A is brought into butt contact with the lower yoke 22B, a space formed between the upper pole 24A and the lower pole 24B becomes a path for the electron beam 14. As shown in FIG. 2, the electron beam 14 within the bending magnet unit 20 acts as a generating source of the SR light. Specifically, the SR light is, as indicated by a reference numeral 25, generated from the electron beam 14 at a point P1 in a tangential direction thereof. Arrows illustrated in FIG. 3 show an example of directions and paths of magnetic flux generated by the upper coil 21A and the lower coil 21B.

In the bending magnet unit 20 with the strength of a magnetic field thereof being not so high, it is not necessary to make the upper coil 21A and the lower coil 21B so large. In this case, the upper yoke 22A and the lower yoke 22B can be located inside and outside the curved portions of the upper coil 21A and the lower coil 21B, respectively. As a result, it is possible to reduce a sectional area of each of outside portions of the upper yoke 22A and the lower yoke 22B extending outside the upper coil 21A and the lower coil 21B because the upper and the lower yokes 22A and 22B extend inside the upper and the lower coils 21A and 21B. In this case, as shown in FIG. 2, it is possible to shorten the length L1 between a point P1 which is a generating point of the SR light and a point P2 which is to be an outlet for the SR light at the outer peripheral surface of the upper yoke 22A and the lower yoke 22B.

Since the strength of the SR light per unit area is inversely proportional to the square of the length from the generating point of the SR light, it is preferable that the length L1 is as short as possible.

Figure 4:
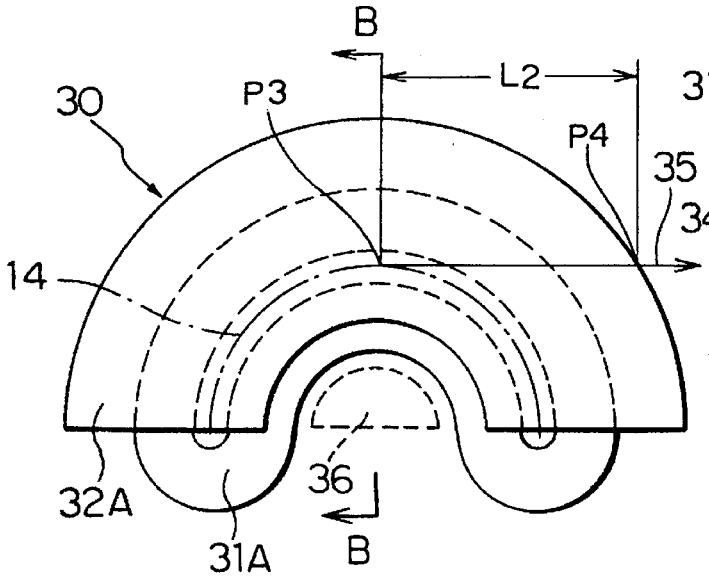
PRIOR ART FIG. 4
FIG. 4 is a plan view showing a second example of the conventional bending magnet unit.
Figure 5:
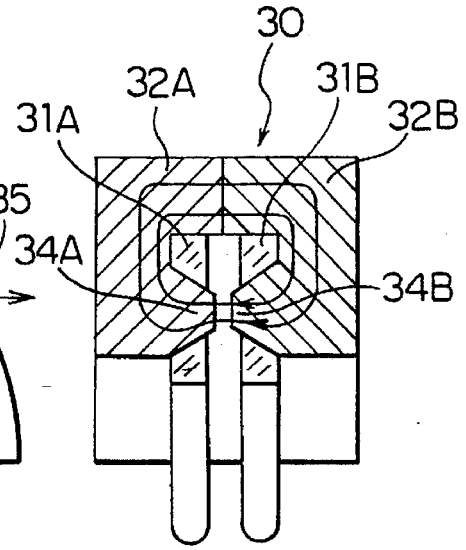
PRIOR ART FIG. 5
FIG. 5 is a vertical sectional view taken along a B—B line in FIG. 4.

Referring to FIGS. 4 and 5, the description will be made as regards a second example of the conventional bending magnet unit. As compared with the first example in FIG. 2, a bending magnet unit 30 is suitable for a case that the strength of a magnetic field is high. The bending magnet unit 30 comprises C-shaped upper and lower coils 31A and 31B each of which has a curved portion and upper and lower yokes 32A and 32B which have double grooves for receiving the upper coil 31A and the lower coil 31B. Along a center line of the double grooves of the upper yoke 32A and the lower yoke 32B, an upper pole 34A and a lower pole 34B are formed, respectively, along the orbit of the arc shape of the electron beam 14 indicated in a dash-and-dot line in FIG. 4. When the upper yoke 32A is brought into butt contact with the lower yoke 32B, a space formed between the upper pole 34A and the lower pole 34B becomes a path for the electron beam 14.

As shown in FIG. 4, SR light 35 is generated from the electron beam 14 at a point P3 within the bending magnet unit 30. Arrows illustrated in FIG. 5 show an example of directions and paths of magnetic flux generated by the upper coil 31A and the lower coil 31B.

In order to center the magnetic flux between the upper pole 34A and the lower pole 34B so as to increase the strength of the magnetic field, it is necessary to widen the sectional area of the upper yoke 32A and the lower yoke 32B. On the other hand, it is also necessary to widen the sectional area of the upper coil 31A and the lower coil 31B in order to increase magnetomotive force. Accordingly, it is not possible to secure a space for the yoke at an inside region 36 of each curved portion of the upper coil 31A and the lower coil 31B. As a result, in order to widen the sectional area of the upper yoke 32A and the lower yoke 32B, it is necessary to thicken a portion, at the upper yoke 32A and the lower yoke 32B, which is outer than the upper coil 31A and the lower coil 31B. This means that the length L2 becomes longer which is from a generating point P3 of the SR light 35 to a point P4 which is to be an outlet for the SR light 35 at the outer peripheral surface of the upper yoke 32A and the lower yoke 32B.

With regard to the radiation shield, it is hard to prevent a problem that the radiations leak from an inlet and an outlet of the electron beam in the bending magnet units illustrated in FIGS. 4 and 5.

Figure 6:
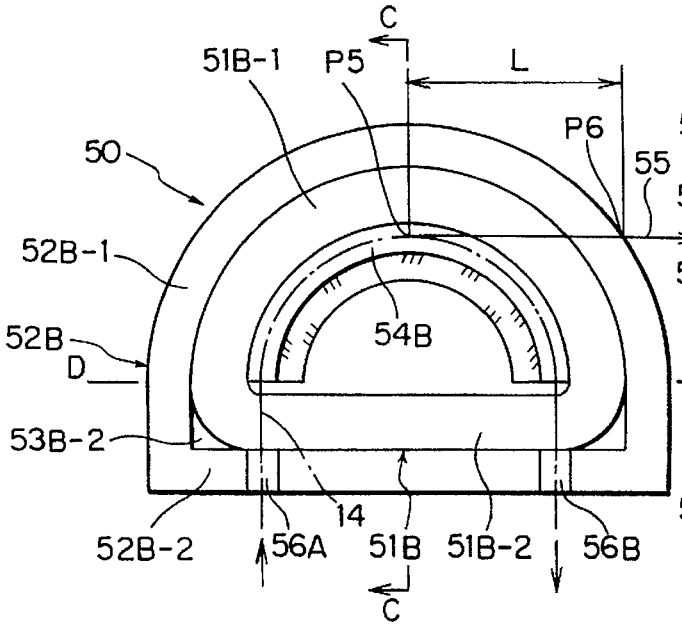
FIG. 6 is a plan view of a lower half portion of a bending magnet unit in an electron storage ring apparatus according to this invention which is seen from the upper side.
Figure 7:
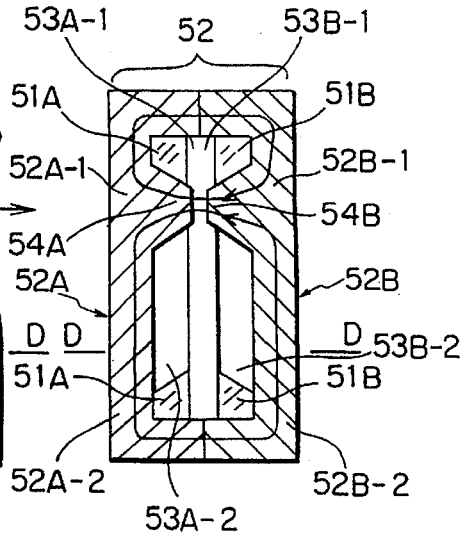
FIG. 7 is a vertical sectional view of the bending magnet unit shown in FIG. 6 which is taken along a C—C line in FIG. 6.
Figure 8:
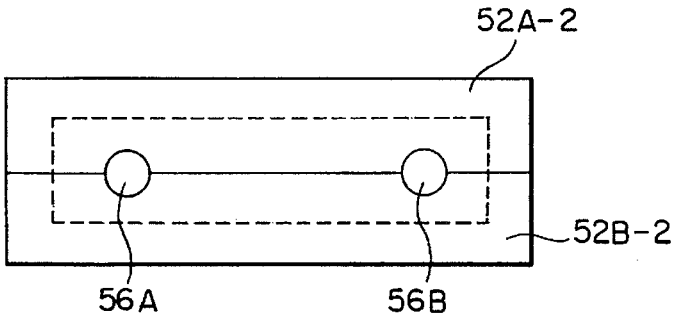
FIG. 8 is a front view of a yoke of the bending magnet unit which is seen from the side of a linear portion thereof.

Referring to FIGS. 6 to 8, the description will be made as regards a preferred embodiment of this invention. FIG. 6 is, as similar as FIGS. 2 and 4, a view showing the lower half portion of a bending magnet unit 50 which is seen from the upper side thereof. The bending magnet unit 50 is suitable for the electron storage ring apparatus of the race track type illustrated in FIG. 1.

In this embodiment, a pair of upper coil 51A and lower coil 51B is formed in a D-shape. The upper coil 51A and the lower coil 51B are received in a yoke 52. The yoke 52 comprises an upper yoke 52A for receiving the upper coil 51A and a lower yoke 52B for receiving the lower coil 51B.

Description is made as regards a lower half portion of the bending magnet unit 50. The lower coil 51B has an arc-shaped portion 51B-1 and a linear portion 51B-2. The lower yoke 52B comprises a semicircular-shaped portion 52B-1 having a single groove portion 53B-1 for receiving the arc-shaped portion 51B-1 of the lower coil 51B and a linear portion 52B-2 having a recessed portion 53B-2 for receiving the linear portion 51B-2 of the lower coil 51B. The recessed portion 53B-2 extends from a base portion of a lower pole 54B which is along the electron beam orbit to a bottom portion of the linear portion of the lower coil 51B and is coupled to the single groove portion 53B-1 at both ends thereof. With this structure, the lower yoke 52B surrounds the entire outer periphery of the lower coil 51B with the semicircular-shaped portion 52B-1 and the linear portion 52B-2 and is welded to the upper yoke 52A at an upper end surface, namely, a neutral surface.

Further, the opposite side from the neutral surface of the lower yoke 52B, namely, a bottom portion, has a board-shape and is connected to the semicircular-shaped portion 52B-1, the linear portion 52B-2, and the base portion of the pole 54B. Additionally, in FIG. 6, although the above-mentioned structural components are formed integrally, they may be divided. For example, the pole 54B may be formed separately from the other portions. In addition, it is preferable in a manufacturing process that the semicircular-shaped portion 52B-1 and the linear portion 52B-2 are divided at a line D—D illustrated in FIG. 6. The upper half portion of the bending magnet unit 50, namely, the upper coil 51A and the upper yoke 52A have a structure similar to the lower coil 51B and the lower yoke 52B.

At inside the single grooves 53A-1 and 53B-1 of the upper and the lower yokes 52A and 52B, an upper pole 54A and the lower pole 54B are formed, respectively, along the orbit of the arc shape of the electron beam 14 as indicated in a dash-and-dot line in FIG. 6. When the upper yoke 52A is brought into butt contact with the lower yoke 52B, a space formed between the upper pole 54A and the lower pole 54B becomes a path for the electron beam 14. As shown in FIG. 6, SR light 55 is generated within the bending magnet unit 20 from the electron beam 14 at a point P5 in a tangential direction thereof. Arrows illustrated in FIG. 7 show an example of directions and paths of the magnetic flux generated by the upper coil 51A and the lower coil 51B.

At a connection surface between the upper yoke 52A and the lower yoke 52B, two recessed portions of a semicircular section are formed to secure the electron beam orbit. The two recessed portions form a hole 56A used as an inlet for the electron beam and a hole 56B used as an outlet for the electron beam, when the upper yoke 52A is welded to the lower yoke 52B. Each of the holes 56A and 56B is penetrated by an electron beam duct (not shown) therethrough. Although the upper yoke 52A and the lower yoke 52B are provided, besides the holes 56A and 56B, with a current-carrying terminal for the coil, a connection port for evacuating, and so on, an illustration and a description thereof are omitted. In addition, although the yoke 52 is provided with a plurality of extraction openings for the SR light, an illustration and a description thereof are also omitted.

The linear portions 52A-2 and 52B-2 are coupled to linear end portions of the semicircular-shaped portions 52A-1 and 52B-1, respectively, and cover each linear portion of the upper coil 51A and the lower coil 51B. With this structure, each of the linear portions 52A-2 and 52B-2 serves as a radiation shielding member as well as serving as a return yoke. In addition, it is possible to restrain increment of the thickness of the outer peripheral side of the semicircular-shaped portions 52A-1 and 52B-1. In other words, the thickness of the outer peripheral side of the semicircular-shaped portions 52A-1 and 52B-1 can be adjusted to the thickness necessary for radiation shielding. This means that it is possible to restrain increment of the length L between a point P5 which is a generating point of the SR light 55 and a point P6 which is to be an outlet for the SR light 55 at the outer peripheral surface of the upper yoke 52A and the lower yoke 52B. As a result, it is possible to reduce the length L to the minimum.

As described above, in the bending magnet unit according to this invention, the coil is formed in a D-shape and the yoke is formed to wrap around the entire coil to have a function as a return yoke. With this structure, it is possible to lower costs because the material amount of the coil can be reduced and a bending process can also be reduced in comparison with a conventional generally C-shaped coil. In addition, the design can be made without wastes since the entire yoke serves also as a radiation shielding member. Moreover, it is possible to restrain increment of the thickness of the yoke located at the extraction side of the SR light, namely, at the outer peripheral side of the yoke. This means that it becomes possible to arrange a sample in a place closer to the SR light generating point and irradiate the SR light thereto. As a result, the same effect can be obtained as a case that the strength of the SR light is increased.

Although a subject of the above-mentioned embodiment is the electron storage ring apparatus of the race track type, this invention is also applicable for an electron storage ring apparatus comprising not less than three bending magnet units. Additionally, the coil used in the bending magnet unit may be either type of normal conducting or superconducting.

What is claimed is:

1. An electron storage ring apparatus comprising at least two bending magnet units for defining an electron beam orbit of an arc shape, which is characterized in that:

each of said bending magnet units comprises D-shaped upper and lower coil members each of which has an arc-shaped portion and a linear portion and upper and lower yokes which have coil receiving grooves for entirely receiving said D-shaped upper and said D-shaped lower coil members, respectively, said upper and said lower yokes being welded to each other so that said D-shaped upper and said D-shaped lower coil members received in said coil receiving grooves face to each other.

2. An electron storage ring apparatus as claimed in claim 1, wherein each of said upper and lower yokes comprises a substantially semicircular-shaped portion having a groove for receiving said arc-shaped portion and a linear portion having a recessed portion for receiving said linear portion, said linear portion being coupled to a linear end portion of said semicircular-shaped portion.

3. An electron storage ring apparatus as claimed in claim 2, wherein said semicircular-shaped portion comprises a pole for defining said electron beam orbit, which is formed inside said groove.

4. An electron storage ring apparatus as claimed in claim 3, wherein said pole is manufactured separately from said semicircular-shaped portion and is coupled to said semicircular-shaped portion so as to define said electron beam orbit.

5. An electron storage ring apparatus as claimed in any one of claims 3 and 4, wherein each of said linear portions of said upper and said lower yokes has a welding portion which is to be welded to each other, each of said welding portions being provided with a path for an electron beam.

6. An electron storage ring apparatus comprising:

at least two bending magnet units for defining an electron beam orbit of an arc shape;

wherein each of said bending magnet units includes:

D-shaped upper and lower coil members each of which has an arc-shaped portion and a linear portion; and upper and lower yokes which have coil receiving grooves for receiving said D-shaped upper and said D-shaped lower coil members, respectively.

7. An electron storage ring apparatus as claimed in claim 6, wherein each of said upper and lower yokes comprises a substantially semicircular-shaped portion having a groove for receiving said arc-shaped portion and a linear portion having a recessed portion for receiving said linear portion, said linear portion being coupled to a linear end portion of said semicircular-shaped portion.

8. An electron storage ring apparatus as claimed in claim 7, wherein said semicircular-shaped portion comprises a pole for defining said electron beam orbit, which is formed inside said groove.

9. An electron storage ring apparatus as claimed in claim 8, wherein said pole is manufactured separately from said semicircular-shaped portion and is coupled to said semicircular-shaped portion so as to define said electron beam orbit.

10. An electron storage ring apparatus as claimed in claim 8, wherein each of said linear portions of said upper and said lower yokes has a welding portion at which said yokes are connected, each of said welding portions are provided with a path for an electron beam.

11. An electron storage ring apparatus as claimed in claim 9, wherein each of said linear portions of said upper and said lower yokes has a welding portion at which said yokes are connected, each of said welding portions are provided with a path for an electron beam.

* * * * *